US007036176B2

(12) United States Patent
Aouad et al.

(10) Patent No.: US 7,036,176 B2
(45) Date of Patent: May 2, 2006

(54) SEQUENTIAL DISPENSING OF LAUNDRY ADDITIVES DURING AUTOMATIC MACHINE LAUNDERING OF FABRICS

(75) Inventors: Yousef Georges Aouad, Cincinnati, OH (US); Arthur Hampton Neergaard, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 525 days.

(21) Appl. No.: 10/366,100

(22) Filed: Feb. 13, 2003

(65) Prior Publication Data

US 2003/0172961 A1 Sep. 18, 2003

Related U.S. Application Data

(60) Provisional application No. 60/356,543, filed on Feb. 13, 2002.

(51) Int. Cl.
*D06F 39/02* (2006.01)

(52) U.S. Cl. ..... 8/159; 68/17 R; 68/207

(58) Field of Classification Search ..... 8/159; 68/17 R, 17 A, 207; 122/80, 129, 132
See application file for complete search history.

(56) References Cited

U.S. PATENT DOCUMENTS

| | | | | |
|---|---|---|---|---|
| 3,028,051 | A * | 4/1962 | Jacobs | 222/41 |
| 3,044,667 | A * | 7/1962 | Lucas | 222/454 |
| 3,180,538 | A * | 4/1965 | Brown et al. | 222/500 |
| 3,212,675 | A * | 10/1965 | Thomas | 222/652 |
| 3,220,607 | A * | 11/1965 | Seal | 222/54 |
| 3,988,908 | A | 11/1976 | Beare et al. | |
| 4,026,131 | A | 5/1977 | Dugger et al. | |
| 4,186,573 | A | 2/1980 | Brenner et al. | |
| 4,260,054 | A | 4/1981 | Bory et al. | |
| 4,265,372 | A | 5/1981 | Wainberg | |
| 4,379,515 | A | 4/1983 | Towsend | |
| 4,416,791 | A | 11/1983 | Haq | |
| 4,429,812 | A | 2/1984 | Steiner et al. | |
| 4,588,080 | A | 5/1986 | Ginn | |
| 4,700,857 | A | 10/1987 | Kittscher et al. | |

(Continued)

FOREIGN PATENT DOCUMENTS

| | | |
|---|---|---|
| CA | 1133712 | 10/2001 |

(Continued)

*Primary Examiner*—Frankie L. Stinson
(74) *Attorney, Agent, or Firm*—Julia A. Glazer; Kim William Zerby; Steven W. Miller

(57) ABSTRACT

Disclosed are systems, methods, devices and kits for sequentially dispensing laundry additive materials into the drum of an automatic washing machine as that machine is used to carry out a fabric laundering operation. To bring about such dispensing of additives, a lidded housing structure is placed within the drum of an automatic washing machine, a multi-compartmented insert, containing different laundry additives in each compartment, is placed within the lidded housing structure, the lid is closed and the machine is run through the several stages of its laundering cycle. Means are provided to open at least one compartment of the insert upon closing of the housing structure lid, thereby dispensing the contents of that opened compartment into the washing machine drum as wash additive materials. Additional means are also provided to open additional compartments of the insert later in the laundering cycle to dispense contents of those additional compartments into the washing machine drum as rinse additive materials. The means for opening such additional compartments of the insert are activated by centrifugal force arising during the spin cycle of the laundering operation.

28 Claims, 9 Drawing Sheets

U.S. PATENT DOCUMENTS

| | | | | |
|---|---|---|---|---|
| 4,882,917 | A | 11/1989 | Mizusawa et al. | |
| 4,982,467 | A | 1/1991 | Mizusawa et al. | |
| 5,033,643 | A | 7/1991 | Schumacher | |
| 5,061,807 | A | 10/1991 | Gethöffer et al. | |
| 5,129,120 | A | 7/1992 | Cornette et al. | |
| 5,133,487 | A | 7/1992 | Russi | |
| 5,176,297 | A | 1/1993 | Mooney et al. | |
| 5,531,081 | A * | 7/1996 | Savkar et al. | 68/17 A |
| 5,536,421 | A | 7/1996 | Hartman et al. | |
| 5,687,588 | A | 11/1997 | Azzani et al. | |
| 5,732,853 | A | 3/1998 | Ganzeboom et al. | |
| 5,792,219 | A | 8/1998 | Hartman et al. | |
| 6,138,693 | A | 10/2000 | Matz | |
| 6,179,167 | B1 | 1/2001 | Boot et al. | |
| 6,203,535 | B1 | 3/2001 | Barney et al. | |
| 6,281,183 | B1 | 8/2001 | Harbour | |
| 6,352,158 | B1 | 3/2002 | Cole-Bennett et al. | |
| 6,378,274 | B1 | 4/2002 | Harbour | |
| 6,439,387 | B1 | 8/2002 | Bergman | |
| 6,571,993 | B1 * | 6/2003 | Rodd et al. | 222/444 |
| 6,581,800 | B1 * | 6/2003 | Rodd et al. | 222/54 |
| 2001/0049846 | A1 | 12/2001 | Guzzi et al. | |
| 2002/0049846 | A1 | 4/2002 | Guzzi et al. | |
| 2002/0078589 | A1 | 6/2002 | Hagemann et al. | |
| 2002/0088502 | A1 | 7/2002 | Van Rompuy et al. | |
| 2002/0100773 | A1 | 8/2002 | Rodd et al. | |
| 2002/0108969 | A1 | 8/2002 | Rodd et al. | |
| 2003/0182732 | A1 | 10/2003 | Davenet et al. | |

FOREIGN PATENT DOCUMENTS

| | | | |
|---|---|---|---|
| DE | 36 09 875 | * | 9/1977 |
| DE | 39 22 342 | * | 1/1991 |
| DE | 39 22 342 A1 | | 1/1991 |
| DE | 39 34 123 A1 | | 4/1991 |
| DE | 101 14 256 A1 | | 3/2001 |
| DE | 19945849 A1 | | 3/2001 |
| EP | 0 215 366 B1 | | 10/1988 |
| EP | 0 351 671 | | 7/1989 |
| EP | 1 195 350 | | 4/2002 |
| WO | WO 94/07979 A1 | | 4/1994 |
| WO | WO 96/26312 | | 8/1996 |
| WO | WO 97/09480 | | 3/1997 |
| WO | WO 00/02982 | | 1/2000 |
| WO | WO 00/02987 | | 1/2000 |
| WO | WO 00/29537 | | 5/2000 |
| WO | WO 00/49218 | | 8/2000 |
| WO | WO 01/07702 A1 | | 2/2001 |
| WO | WO 01/07703 A1 | | 2/2001 |
| WO | WO 01/07704 A1 | | 2/2001 |
| WO | WO 01/16271 | | 3/2001 |
| WO | WO 01/23295 A2 | | 4/2001 |
| WO | WO 01/25526 A1 | | 4/2001 |
| WO | WO 01/25527 A1 | | 4/2001 |
| WO | WO 03/069042 | | 8/2003 |
| WO | WO 03/069043 | | 8/2003 |
| WO | WO 2004/044303 A1 | | 5/2004 |

* cited by examiner

SEQUENTIAL DISPENSING OF LAUNDRY ADDITIVES DURING AUTOMATIC MACHINE LAUNDERING OF FABRICS

CROSS REFERENCE TO RELATED APPLICATIONS

This application claims priority under 35 U.S.C. § 119(e) to U.S. Provisional Application Ser. No. 60/356,543, filed Feb. 13, 2002.

TECHNICAL FIELD

The present invention relates to systems, methods and devices for adding separate laundry additive materials to the drum (tub) of an automatic fabric laundering (washing) machine during its cycle of operation. The separate laundry additive materials themselves are packaged in a unit dose form which is inserted into a holder device within the washing machine drum in order to effect sequential dispensing of the materials into the drum.

BACKGROUND OF THE INVENTION

There are a great many types of laundry additive materials suitable for use in automatic washing machines for fabric laundering. Cleaning agents such as surfactants and detergent builders are used to assist in the mechanical removal of soil and stains from fabrics being laundered. Bleaching agents, enzymes and adjuvants relating thereto are designed to promote chemical degradation and removal of soils and stains. Fabric conditioners, softeners, anti-wrinkle agents, soil release materials and similar agents serve to alter and enhance the condition, appearance or feel of laundered fabrics. Other auxiliary materials, such as pH adjustment and control agents, buffers, solvents, dispersants, anti-redeposition agents, dye transfer inhibitors, stabilizers, preservatives, perfumes, dyes and the like are used to alter the aqueous environment in the automatic washing machine drum to provide for optimum performance of the active laundry additive materials or to improve the quality or aesthetics of commercialized laundry products containing these active additive materials.

The several types of laundry additive materials described hereinbefore, frequently intermingled or admixed together in a wide variety of combinations for convenience, are commonly marketed to consumers in bulk quantities, in either solid, i.e., granular or tablet, or liquid form. To carry out the laundering operation, the consumer then adds aliquots of product as needed or desired from the bulk products into the automatic washing machine drum in appropriate amounts and at appropriate times during the laundering cycle.

It would be desirable, and a number of attempts have been made, to market fabric laundering products in "unit dose" form whereby aliquots of combinations of laundry additive materials are provided in pre-measured, pre-packaged form. The consumer can then conveniently add one of these unit dose aliquots to the automatic washing machine, e.g., into the drum, at the beginning of the laundry cycle and not have to measure product from bulk or add product to the cycle at different subsequent points in time.

Several factors complicate the provision of multiple types of laundry additive materials in unit dose form. In the first place, many types and forms of laundry additives are not compatible with each other with in a single concentrated product. Different types of materials may chemically interact with each other when admixed in concentrated form, thereby degrading and rendering one or both types ultimately ineffective for its intended purpose. Such incompatibility works against combining such materials together within a single unit dose product.

Secondly, during the laundering cycle itself, different types of laundry additives work best under different sets of conditions which occur as the laundering operation progresses through its cycle which generally includes washing and rinsing stages within the drum. It therefore becomes advantageous to add different types of laundry additives to the washing machine drum at different times during the laundering cycle. This timed or staged addition of separate, distinct materials to the automatic washing machine drum is also difficult to accomplish with product packaged in unit dose form.

Given the foregoing difficulties in formulating unit dose products for use in fabric laundering operations carried out in a multi-cycle, drum-containing automatic washing machine, it is an objective of the present invention to provide a system which can effectively utilize laundry additive products in unit dose form to deliver a wide variety of ingredients to the drum of an automatic fabric laundering machine during its operational cycle. Such an objective is realized by providing a unit dose in the form of a multi-compartmented package. Such a package is then placed as an insert into a housing device which is positioned within the washing machine drum and which serves to bring about the sequential dispensing of laundry additives from the several compartments of the insert.

BACKGROUND ART

Devices which can dispense laundry additive materials into one or more stages of a machine laundering operation are disclosed in U.S. Pat. No. 4,186,573 and PCT Publication WO 01/25526. Products in the form of a pouch or container which can be used for the staged or delayed dispensing of laundry additive materials into a machine fabric laundering operation are disclosed in U.S. Pat. Nos. 4,026,131; 4,260,054; and 4,588,080; and in Canadian Patent 1,133,712. Arrangements involving a dispensing device and a pre-packaged amount of laundry additive material for staged or timed dispensing during a laundering operation are disclosed in U.S. Pat. Nos. 4,379,515 and 4,882,917 and in PCT Publications WO 01/07703 and WO 01/07702.

SUMMARY OF THE INVENTION

In its system aspects, the present invention is directed to an arrangement of mechanical elements which provides for the sequential dispensing of laundry additive materials into the several stages of the laundering cycle which occur during the operation of a drum-containing automatic fabric laundering machine. Such an arrangement comprises a rigid housing structure positioned within the washing machine drum, a multi-compartmented insert which can be placed within the housing and which contains the laundry additive materials to be dispensed into the washing machine drum, and means for opening the compartments of the multi-compartmented insert.

The rigid housing structure is positioned within the automatic washing machine in a fixed spatial relationship to the drum of the washing machine. This housing structure comprises a base which can hold the multi-compartmented insert and a closable lid for this base.

The multi-compartmented insert can be placed within the housing structure at the beginning of the laundering operation. This insert contains at least two different laundry additive materials within at least two different ones of its compartments. These different laundry additive materials are to be added to the contents of the washing machine drum at different times during the laundering cycle.

The rigid housing structure has means associated with it which serve to open at least a first compartment of the multi-compartmented insert upon closing of the lid of the housing structure after the insert has been positioned within the housing structure. The opening of these first compartment(s) permits the dispensing of the contents of the opened compartment(s) into the washing machine drum at the beginning of the washing cycle.

The system herein also comprises additional means associated with either the housing structure or with the insert or with both to open one or more additional compartments of the insert. Such additional compartment(s) must contain laundry additive material(s) which is/are different from that in at least one of the previously opened compartments of the insert. The opening of these additional compartments occurs after initiation of the spin cycle of the washing machine operation, and the means for opening the additional compartments of the insert are activated by the centrifugal force which arises as a consequence of running through the spin cycle during the operation of the washing machine. As with the opening of the first compartment(s), the opening of the additional compartment(s) of the insert permits the dispensing of the compartment contents into the washing machine drum.

In its method aspects, the present invention relates to the procedure of using the system described hereinbefore to bring about the sequential dispensing of different laundry additive materials into the several stages of the laundering cycle during the operation of a drum-containing automatic washing machine for fabric laundering. Such a method comprises first positioning the rigid housing structure hereinbefore described in a fixed spatial relationship to the drum of the automatic washing machine. Then, with the lid of the housing structure open, a multi-compartmented insert as hereinbefore described is inserted into the housing structure at the beginning of the laundering operation. Such an insert contains within at least two different compartments at least two different laundry additive materials which are to be added at different times to the contents of the washing machine drum during the laundering cycle. Next the lid of the housing structure is closed, thereby activating means associated with the structure to open at least a first compartment of the insert. This opening serves to dispense contents of the initially opened compartment(s) into the drum at the beginning of the washing cycle. Finally the automatic washing machine is then run through its operational cycle, including its spin cycle, to thereby activate via centrifugal force from the spin cycle means associated with the housing structure or with the insert to open additional compartments of the insert containing laundry additive materials different from those of the previously opened first compartment(s). The opening of the additional compartments of the insert also permits dispensing of the contents of those compartments into the drum of the washing machine.

In its device aspects, the present invention relates to the rigid housing structure hereinbefore described. It is this housing structure which is to hold the unit dose insert as hereinbefore described and bring about the sequential dispensing of laundry additive materials from the insert. The housing structure must be suitable for positioning in a fixed spatial relationship to, and preferably within, the drum of an automatic washing machine for fabric laundering. The housing structure comprises a base which is suitable for holding the multi-compartmented insert containing the laundry additive materials to be dispensed. The structure further comprises an openable and closable lid for the base. Finally, the housing structure comprises means for initially opening at least some, but not all, of the compartments of the multi-compartmented insert which is placed within the structure. Such opening means are activated when the lid of the structure is closed with the multi-compartmented insert inside the structure at the beginning of the laundering cycle.

In its "kit" aspects, the present invention relates to combinations of items which can be provided or sold together in order to facilitate assembly and use of the laundry additive material dispensing systems herein and the practice of the methods of this invention. Thus such kits can comprise the combination of the multi-compartmented insert as hereinbefore described and the rigid housing structure also as hereinbefore described. Such kits can also comprise the multi-compartmented unit dose inserts in combination with instructions on how to use such inserts with a pre-existing rigid housing structure in order to assemble the laundry additive dispensing systems herein or in order to carry out the methods-of-use herein.

DETAILED DESCRIPTION OF THE INVENTION

Figure 1A:
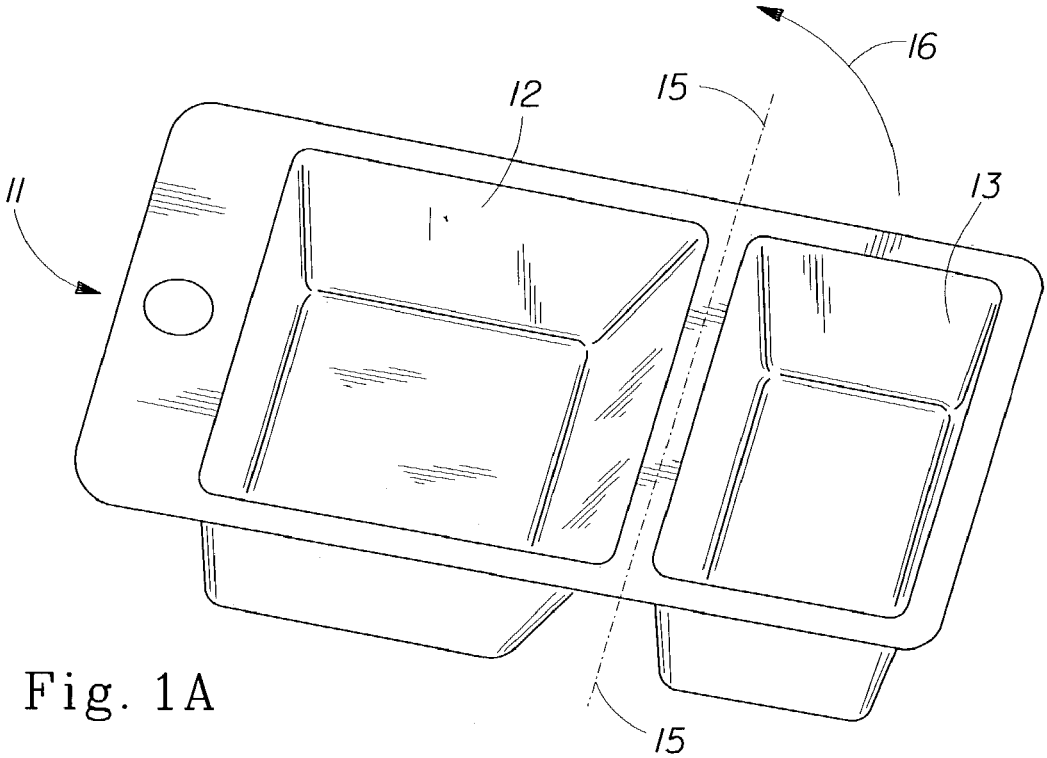
FIGS. 1A and 1B of the drawings show top and bottom views of one type of a two-compartment unit dose insert which can be utilized in the present invention.

The present invention relates to the sequential dispensing of laundry additive materials into the drum of an automatic washing machine as that machine is used for fabric laundering operations. For purposes of this invention, "laundry additive materials" can comprise any solid or liquid materials which are conventionally added to the automatic washing machine drum, along with the fabrics being laundered, in order to effectively carry out the desired laundering procedure. Thus the list of suitable "laundry additive materials" includes, but is not limited to, detersive surfactants, detergent builders, bleaches, enzymes, bleach and enzyme stabilizers, bleach and enzyme activators, aqueous and non-aqueous solvents, pH adjustment and control agents, dispersants, anti-redeposition agents, dye transfer inhibitors, preservatives, anti-microbial agents, soil release agents, anti-wrinkle agents, fabric softeners and conditioners, chelating agents, suds suppressors, suds boosters, optical brighteners, perfumes, pro-perfumes, dyes, and carriers. A more detailed description of various laundry additive materials useful in this invention can be found in WO 00/02982 and WO 00/02987.

Dispensing of laundry additive materials in accordance with this invention takes place in a conventional automatic washing machine useful for the laundering of fabrics. Such automatic washing machines are those typically found in the home or in businesses such as self-service laundromats wherein individual consumers can launder their own loads of fabrics.

Automatic washing machines of the "North American" configuration typically utilize an upright or vertical drum or tub into which fabrics to be laundered are placed. Fabrics and laundry additives are added into the washing machine tub or drum, which is usually cylindrical, from the lidded top of the machine and are thus generally referred to as "top-loading" machines. Such North American style machines will frequently utilize a vertical agitator element placed along the axis of the drum. Rotation and vertical motion of the agitator serves to intensify the contact of fabrics in the drum with wash and rinse water in the drum. Japanese washing machines are typically similar in configuration to the North American machines.

Automatic washing machines of the "European" configuration commonly utilize a drum or tub, also generally cylindrical, which is positioned with the drum axis sideways or in a horizontal position. Fabrics and laundry additive materials are placed into the tub or drum of a washing machine of this configuration though a door on the front wall of the machine and are thus generally referred to as "front-loading" machines. Automatic washing machines of the European configuration typically do not utilize an agitator device or element.

Both North American and European automatic washing machines utilize a cycle of operation wherein the machine goes through a series of steps in which water is added, contacted with fabrics being laundered and then removed from the washing machine drum. Thus after fabrics are added to the drum, the first step in the laundering cycle is usually a washing step wherein significant amounts of water are added to the drum. The washing step involves a period wherein the fabrics being laundered are contacted with substantial amounts of water, generally with agitation or rotation of the drum. Water in the washing step will usually contain the primary laundry additives such as surfactants, builders, bleaches and/or enzymes which assist in and promote the removal of soil and stains from the fabrics being laundered.

At the conclusion of the washing step, water is removed from the washing machine drum. Frequently, this is brought about by gravity flow of wash water from the drum through appropriate valve configurations. Generally wash water is also removed by means of centrifugal force brought about by the drum rotating rapidly in a spin cycle. This centrifugal force moves water in the drum through holes or apertures in the circumferential walls of the drum. These holes lead to drainage means which can be opened and shut.

After the initial spin cycle, clean water is added back to the drum in a rinse cycle. Secondary laundry additives such as fabric softeners or conditioners are generally contacted with the fabrics being laundered during the rinse cycle. Washing machine operation may also involve several additional spinning and rinsing cycles.

The system, methods, apparatus and kits of the present invention are intended to provide sequential dispensing of different laundry additive materials into the laundering process from a single multi-compartmented unit dose package. Such additive materials are dispensed into the washing machine as the machine proceeds through its operational wash and initial spin and rinse cycles as hereinbefore described. This is accomplished using a housing structure which is positioned within the machine and which holds and successively opens compartments of a unit dose package containing the additive materials to be sequentially dispensed. Ideally the unit dose used herein will contain from 15 to 100 grams, preferably from 40 to 80 grams, of laundry additive materials for delivery to the wash cycle of an automatic washing machine laundering operation and from 5 to 50 grams, preferably from 15 to 35 grams, of additional laundry additives for delivery to one or more subsequent "rinse" cycles in this laundering operation.

The rigid housing structure used in the instant invention must be positioned in a fixed spatial relationship to the washing machine drum. Preferably, the rigid housing structure will be positioned within the washing machine drum in a location such that it will be in contact with the wash or rinse water in or being added to the drum during the wash and rinse cycles of the laundering operation. The housing structure may be positioned on or near the washing machine agitator (if there is one) or may be positioned on the floor (top loaders) or rear wall (front loaders) of the drum. Most preferably, however, the rigid housing structure will be affixed to the inner circumferential wall of the washing machine drum in a position so that at least at some point during the washing and rinsing cycles it is in contact with water used in the cycle. For North American washing machines, this position will preferably be below the fill line for water in the drum.

The rigid housing structure will comprise a base element and an openable and closable lid for the base. Typically this arrangement will involve a hinged lid on a three-dimensional base element. The three-dimensional base element can be sized and configured in order to hold in an appropriate way the multi-compartmented unit dose package which carries the additive materials to be dispensed.

The rigid housing structure must also have means associated with it to open at least one of the compartments of the multi-compartmented insert which fits into it. Such means are generally activated by the closing of the lid of the housing structure once the multi-compartmented unit dose insert has been placed inside the structure. Such opening means can comprise, for example, selectively located puncturing or rupturing means such as sharp protrusions or knife blades which impinge on one or more of the selectively positioned compartments of the unit dose insert. The rupturing or puncturing means are then configured to move with the closing of the lid such that this movement causes the desired compartment(s) of the insert to be opened. Such compartment opening means may be associated with the housing structure base, the structure lid or both.

Alternatively, the opening means for the first compartment(s) of the insert could comprise and arrangement of holes or apertures in the housing structure which are opened as the lid of the housing structure is closed. Opening of the holes or apertures in the housing could then permit water from the washing step to enter the housing and dissolve those of the inert compartments which are water-soluble or which are at least openable by virtue of having water-soluble sealing means.

Preferably the rigid housing structure will also further comprise second means for opening additional compartments of the insert which is positioned therein. Such additional compartments will contain laundry additive materials which are different from those in the first compartment(s) initially opened as a consequence of the closing of the housing structure lid. These second means for opening additional compartment(s) of the unit dose insert are activatable by the centrifugal force applied to the housing structure during and as a consequence of the spin cycle during operation of the washing machine being used. Thus, for example, the second means for opening additional compartment(s) may also comprise sharp protrusions, blades or knives which will impinge on the additional compartment(s) of the unit dose insert which are to be opened during the spin cycle. The insert can be kept from initially contacting the second opening means (until the spin cycle), for example, by a hinged or otherwise movable positioning plate or baffle within the housing structure. Such a baffle or plate will hold the insert in a position such that the additional compartment(s) of the insert do not, upon initial closing of the housing structure, impinge upon the second compartment opening means. However, upon application of spin cycle centrifugal force, the insert can be held by the positioning plate or baffle in a position whereby the second compartment(s) will be moved by the applied centrifugal force into position for puncturing of the insert by the second compartment opening means. Alternatively, the preferred second opening means for additional compartments, like the initial opening means, can comprise a movable housing structure element which will open holes upon application of the spin cycle centrifugal force. Water entering though these opened holes can then dissolve or otherwise open the appropriately constructed and positioned additional compartment(s) of the insert. As with the opening means for the first insert compartment(s), the second means for opening additional compartment(s) of the insert may be associated with the housing structure base, the structure lid or both.

The rigid housing structure must also be configured to permit water to eventually enter the structure during all of the various cycles of the laundering operation and to permit the contents of the opened insert compartments to be dispensed from the structure into the washing machine drum. Most frequently this configuration will include appropriately placed and positioned holes or apertures in the housing structure through which water from the laundering operation can enter and leave and through which laundry additive materials from the opened insert compartments can flow into the washing machine drum.

In a preferred configuration, the rigid housing structure will be able to hold substantially all (at least 90% by weight) of the rinse additive contents of the spin-cycle opened insert within the rigid housing until the spin cycle is completed. Thus the centrifugal force which opens the additional insert compartment(s) can also be used to hold the contents released from the opened compartment(s) within the structure, and even in some cases still within the opened compartment(s) of the insert, until the spin cycle is over. At the conclusion of the spin cycle, when the centrifugal force ceases, the contents of the opened inserts can then be allowed to flow from the structure, for example by gravity through holes in the "bottom" of the structure. Alternatively, upon cessation of the spin cycle centrifugal force and addition of rinse water to the drum, the released rinse additive materials can be washed from the structure, and into the washing machine drum, by rinse water then entering the housing. By having the structure hold the released rinse additive materials until the spin stops, the rinse additive material can thereby be kept from being washed out of the washing machine drum by being forced out of the drum through the drainage holes in the drum wall during the spin cycle.

Opening of each of the several compartments of the insert within the housing structure should permit most (at least 85% by weight), and preferably all, of the contents of the compartment so opened to be eventually combined with the wash or rinse water present in the washing machine drum during the cycle in which the compartment is opened. The wash water in the drum during the wash cycle will typically have delivered thereto from 15 to 100 grams, preferably from 40 to 80 grams, of laundry additive materials as a consequence of the opening of the wash additive compartment(s) of the insert. Rinse water in the drum for any rinse cycle during which a rinse additive compartment is opened in the insert will typically eventually have added thereto from 5 to 50 grams, preferably from 15 to 35 grams, of rinse additive material as a consequence of the opening of the rinse additive compartment(s).

The rigid housing structure can be fashioned from any suitable solid material including plastic, metal, ceramic, wood, etc. so long as the structure maintains its configuration and mode of operation through the laundering cycle and in contact with the wash and rinse water used and with the laundry additive materials released from the opened unit dose insert compartments. Preferably the rigid housing structure will be fashioned from thermoformed or injection molded plastic so that it can be readily and cost effectively mass-produced.

The multi-compartmented unit dose insert itself must be sized and configured so as to work cooperatively with the rigid housing structure into which it fits and within which it is used. The unit dose insert will thus comprise at least two separate compartments, at least one for laundry additive materials which are to be dispensed into the wash water at the beginning of the laundering operation and at least one for rinse additive materials which are to be dispensed into the subsequent rinse cycle during the course of the laundering operation. Of course, the unit dose insert may utilize more than one compartment for the wash water additive materials and more than one compartment for the rinse additive materials. This may be useful when two wash or rinse additive materials are incompatible with each other and may be desirably separately packaged until they are added to the washing machine drum.

Each compartment of the unit dose insert may be fashioned from water-insoluble materials, water-soluble materials or combinations of both types. Furthermore, some compartments of the insert may be made from water-insoluble materials while other compartments can be made from water-soluble materials. The compartments of the insert may also be flexible or rigid or have some compartments flexible and other compartments rigid.

If the unit dose insert is to be rigid, it may be made from any conventional polymeric material which can be thermoformed or injection molded. Thus polyethylene, polypropylene, polystyrene or polyester (e.g., polyethylene terephthalate) may be used to form the multi-compartmented insert. A polymer material should be chosen which has good heat stability, especially if the insert is to be utilized in European washing machines where water temperatures approach boiling. The material of the insert should also be inert to any chemicals which are present in the laundry additives which the insert is to deliver.

A preferred configuration for the unit dose insert comprises a multi-compartmented thermoformed tub formed from water-insoluble plastic, such as for example, polypropylene or polyethylene. The compartments of the tub can be sealed with a thin layer of puncturable or rupturable plastic or metal, e.g., aluminum, foil. In another preferred configuration, a pouch with the wash water additives may be flexible and fashioned from water-soluble materials, e.g., polyvinyl alcohol, and this water-soluble pouch may be affixed to a flexible or rigid pouch or compartment made from water-insoluble materials and containing the rinse additive materials to be dispensed later in the laundering cycle.

In a preferred embodiment herein, the multi-compartmented insert itself may contain the means for opening the compartment(s) containing rinse additive materials. These are the compartments to be opened by means of the centrifugal force applied to the insert during the spin cycle of the laundering operation. Such rinse additive compartments may thus contain a frangible seal which comes apart or opens as pressure on the contents of the compartment increases as a consequence of the centrifugal force applied during the spin. Alternatively, the means for opening the rinse additive compartment(s) may be part of the housing structure as hereinbefore described. Of course, the means for opening the rinse additive compartment(s) must be present in association with at least one of the rigid housing structure or the multi-compartmented insert itself so that, one way or another, the rinse additive compartment(s) will be opened at the appropriate time during the laundering operation.

Figure 1B:
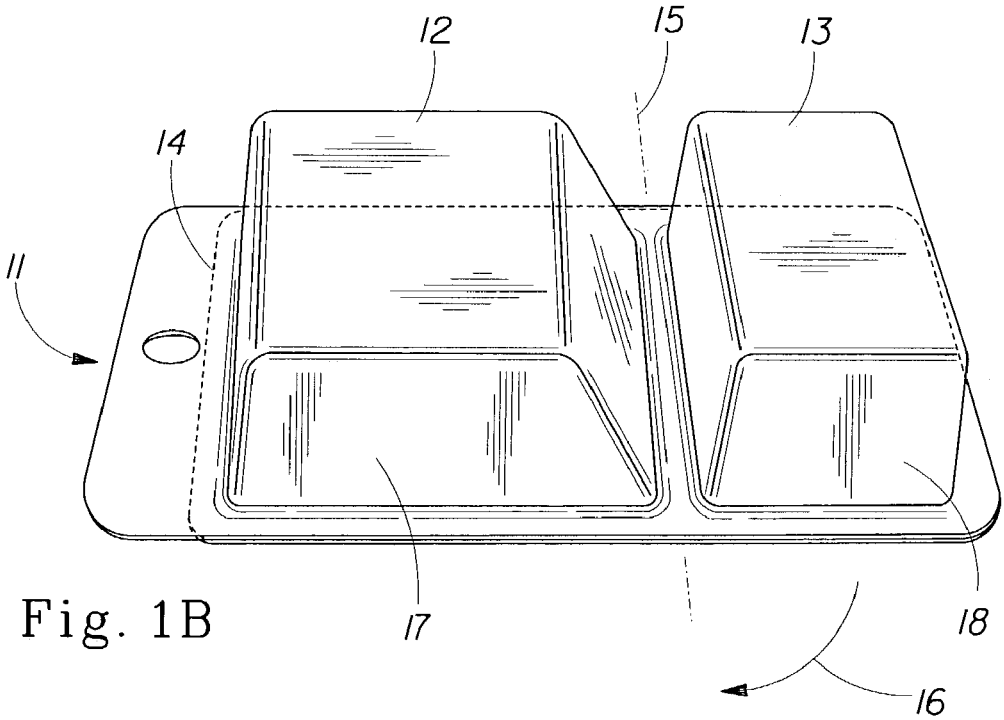

The multi-compartmented unit dose insert, the rigid, lidded housing structure and their relationship to each other for use in the systems and methods and kits herein are all illustrated further by the accompanying drawings. FIGS. 1A and 1B of the drawings show top and bottom views, respectively, of a two-compartment unit dose insert 11 which can be employed in the practice of the present invention. This compartmented unit dose insert 11 can be made of relatively rigid, insoluble thermoformed polypropylene. It has a major compartment 12 suitable for storage of liquid laundry additive 17, such as heavy duty liquid detergent, to be dispensed into the wash cycle of a laundering operation. The two-compartment unit dose insert 11 also has a smaller minor compartment 13 suitable for holding liquid laundry additive 18, such as fabric conditioning agent or pH control agents, to be dispensed into the rinse cycle of the laundering operation.

Prior to use, both compartments are sealed across the top with a puncturable or rupturable layer 14 of film or foil which covers both compartments 12 and 13. The material of construction of the insert 11 is not rigid enough to prevent the two compartments from rotating with respect to each other around an axis 15 represented by the strip of material between the two compartments. It is this rotation feature around an arc 16 which permits the centrifugal force-initiated movement and consequent puncturing of the rinse additive compartment 13 when the insert is placed within a housing structure as shown hereafter in FIG. 3.

Figure 2A:
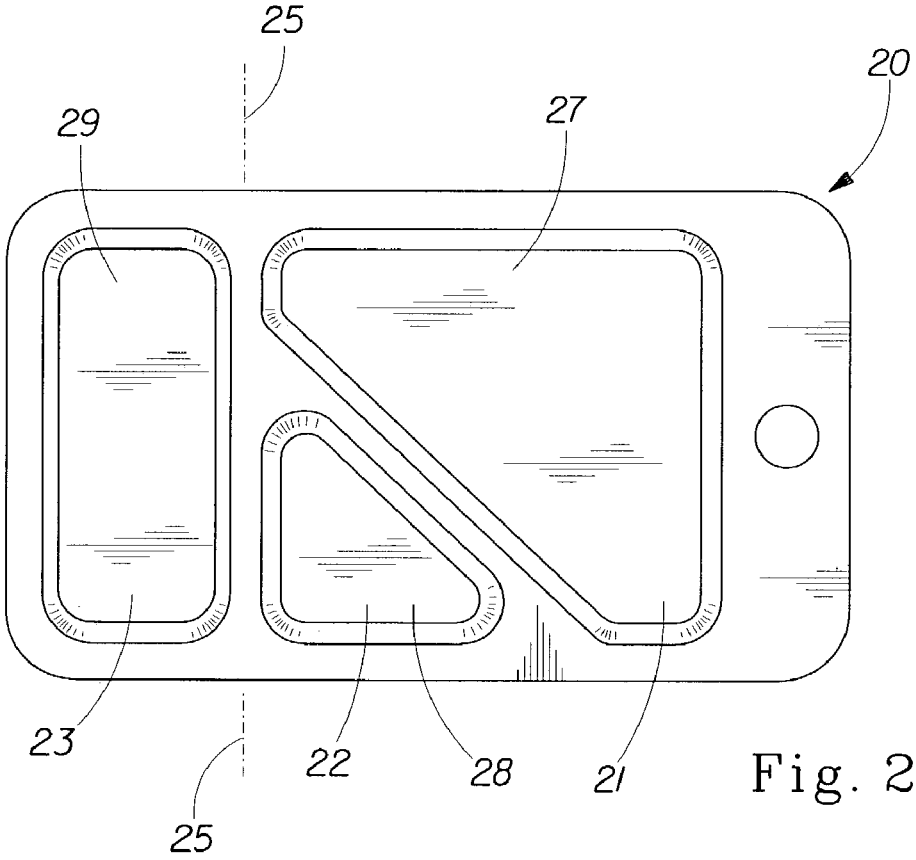
FIGS. 2A and 2B of the drawings show top and bottom views of another type of three-compartment unit dose insert which can be utilized in the present invention.
Figure 2B:
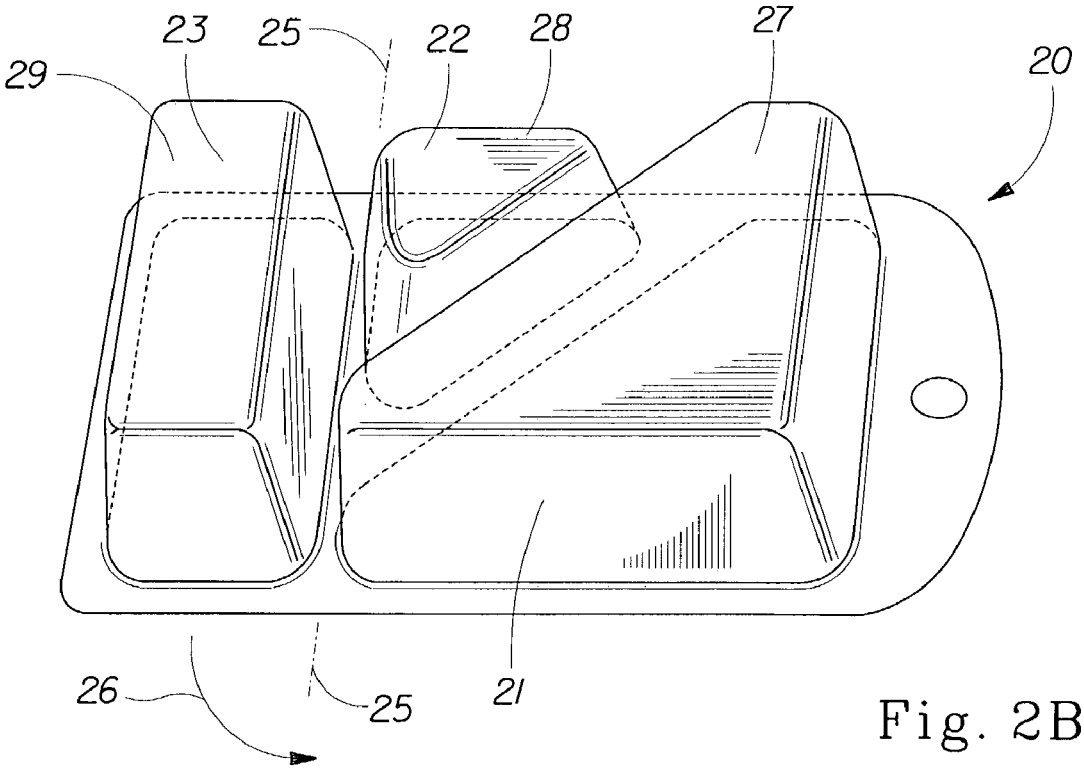

FIGS. 2A and 2B show top and bottom views, respectively, of a three-compartment unit dose insert 20 which can be employed in the practice of the present invention. This three-compartmented unit dose insert 20 has a large compartment 21 which holds a liquid laundry detergent product 27 and a smaller compartment 22 which holds a granular peroxygen bleaching agent product 28. It is the contents of compartments 21 and 22 which are incompatible with each other if combined prior to use, and which are both dispensed approximately simultaneously into the wash cycle when the compartments containing each are both initially opened at the beginning of the laundering operation. The third compartment 23 holds a liquid rinse additive product 29. It is this rinse additive product 29 which is later in the laundering operation to be dispensed into the rinse cycle.

As in the two-compartment unit dose insert of FIGS. 1A/1B, the compartments of the FIGS. 2A/2B unit dose insert 20 are sealed across the top with puncturable or rupturable film or foil (not shown) prior to the insertion of the unit dose 20 into a housing structure for use in accordance with this invention. Also as with the FIGS. 1A/1B insert, the FIGS. 2A/2B unit dose insert 20 has an axis 25 between the wash additive compartments 21 and 22 and rinse additive compartment 23 around which the rinse additive compartment 23 can rotate relative to the 21 and 22 compartments following arc 26. It is this rotational feature around arc 26 which permits the eventual centrifugal force-induced movement and accordingly eventual puncturing of the rinse additive compartment 23 when the insert 20 is placed into a housing structure as hereinafter illustrated in the FIG. 3 and FIGS. 4A, 4B, and 4C depictions.

Figure 3:
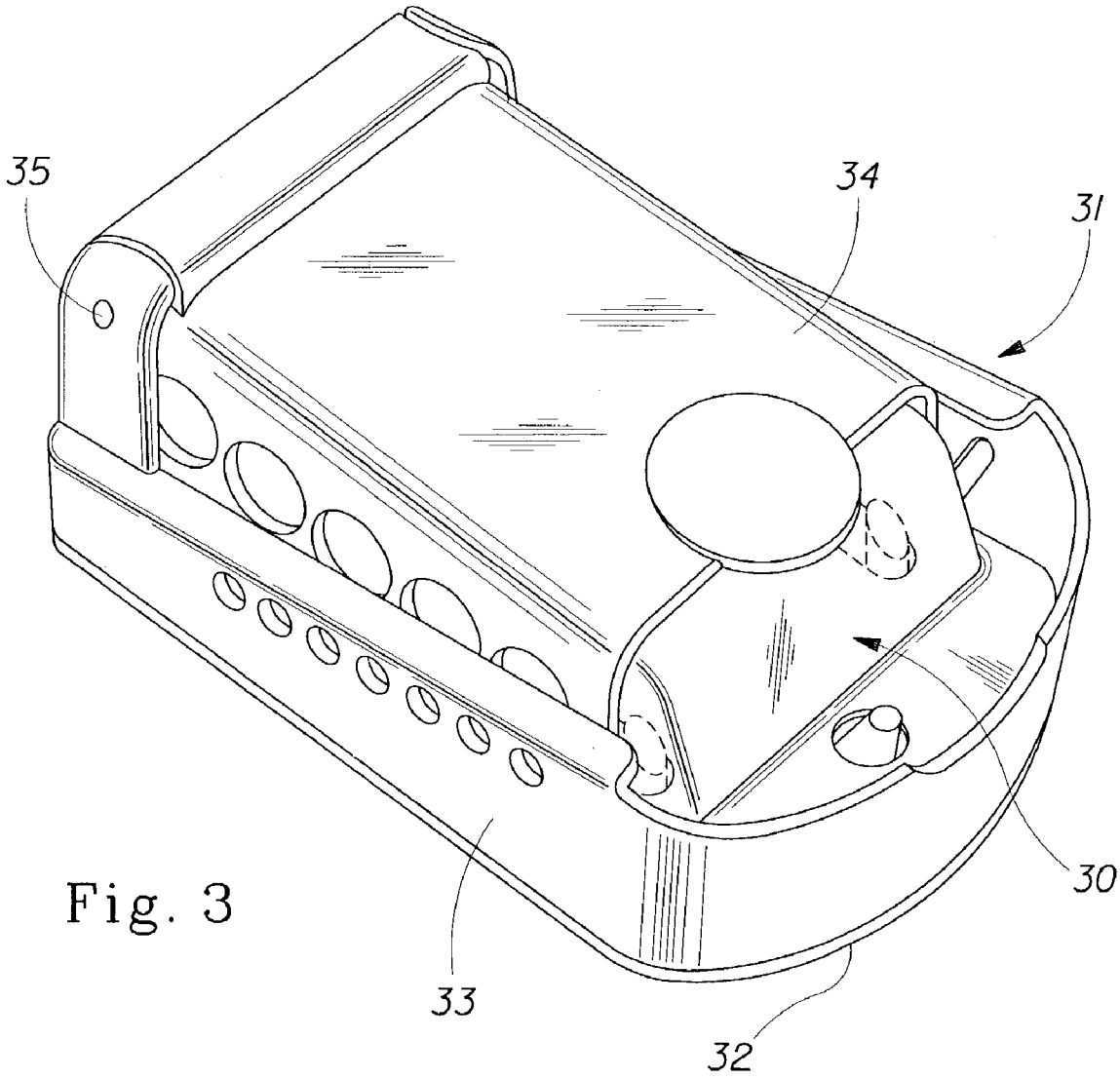
FIG. 3 of the drawings show a perspective view of a unit dose insert positioned within a closed rigid housing structure suitable for practice of the present invention.

FIG. 3 shows a perspective view of an insert 30, such as depicted in FIGS. 1A and 1B, which has been inserted into a lidded housing structure 31 which has been closed with the insert 30 inside. The housing structure 31 itself comprises a base plate 32 surrounded by a side wall structure 33 affixed to the base plate 32. A lid 34 completes the housing structure and is affixed to the side wall structure 33 by means of a hinge 35. More details of the internal components of the housing structure 31 are shown in the transparent side views of FIGS. 4A, 4B, and 4C.

Figure 4A:
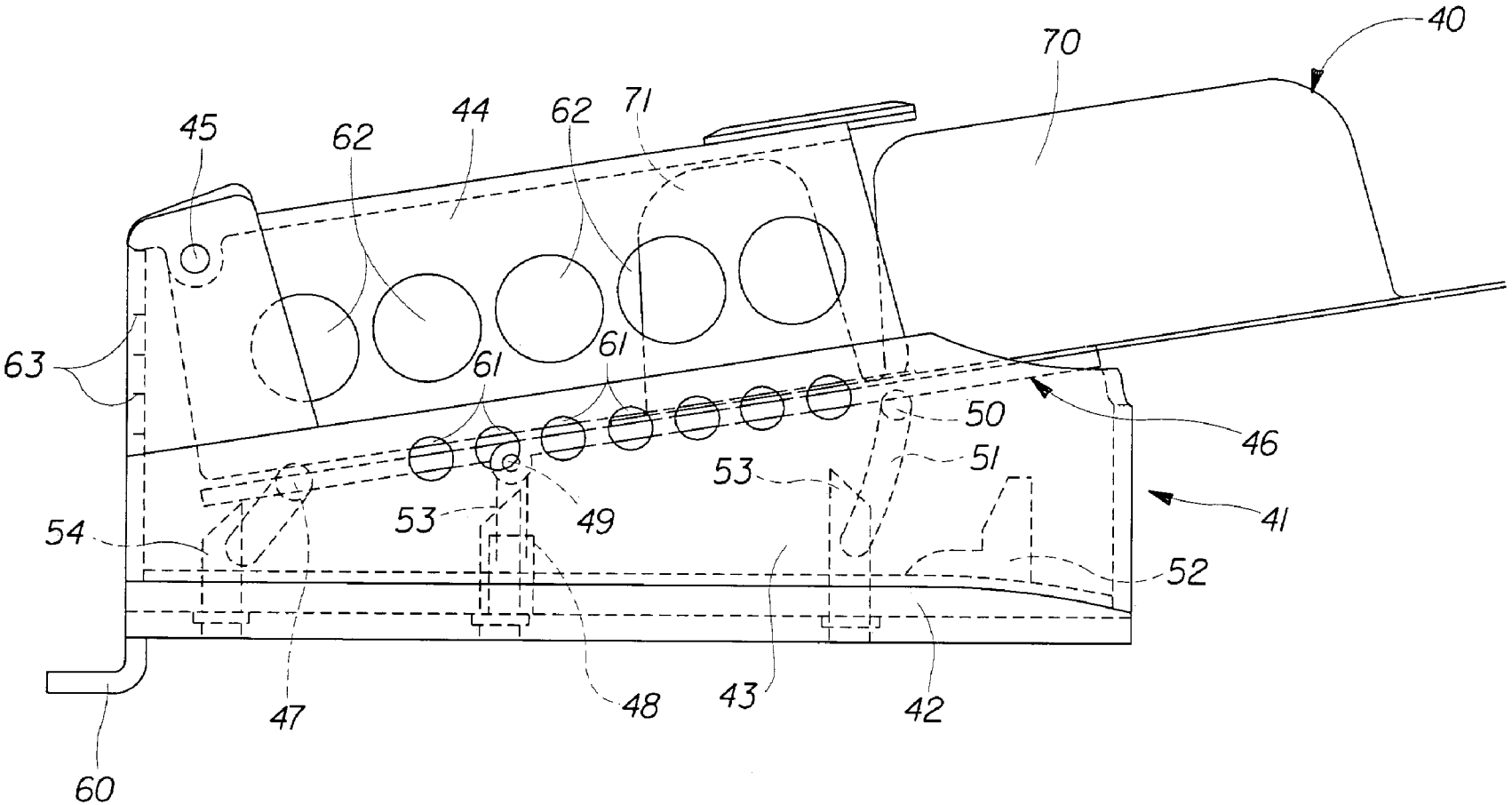
FIGS. 4A, 4B, and 4C of the drawings show three side views of the insertion and use of a multi-compartmented unit dose insert into one embodiment of a lidded, rigid housing structure suitable for the practice of the present invention.
Figure 4B:
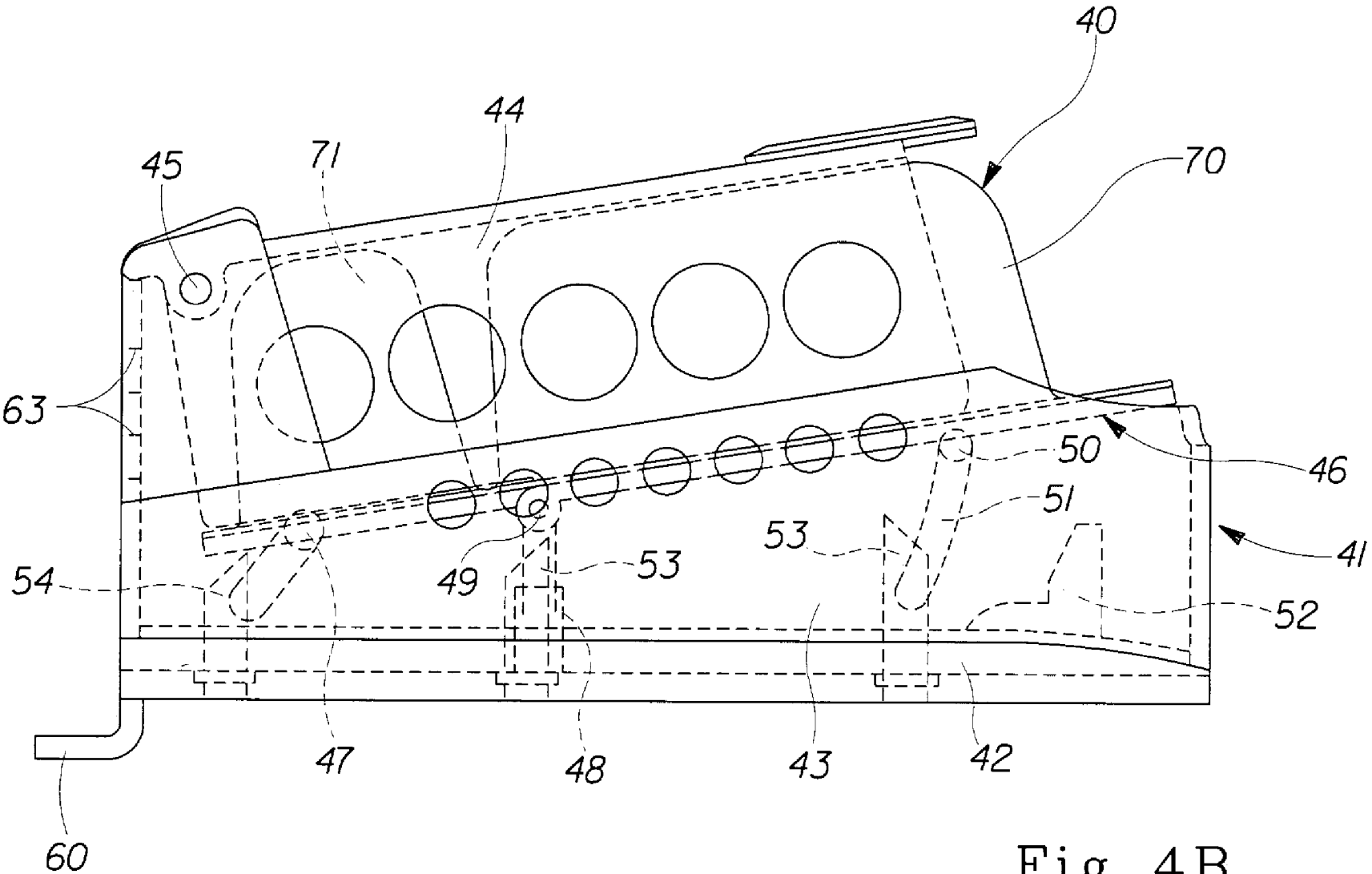
Figure 4C:
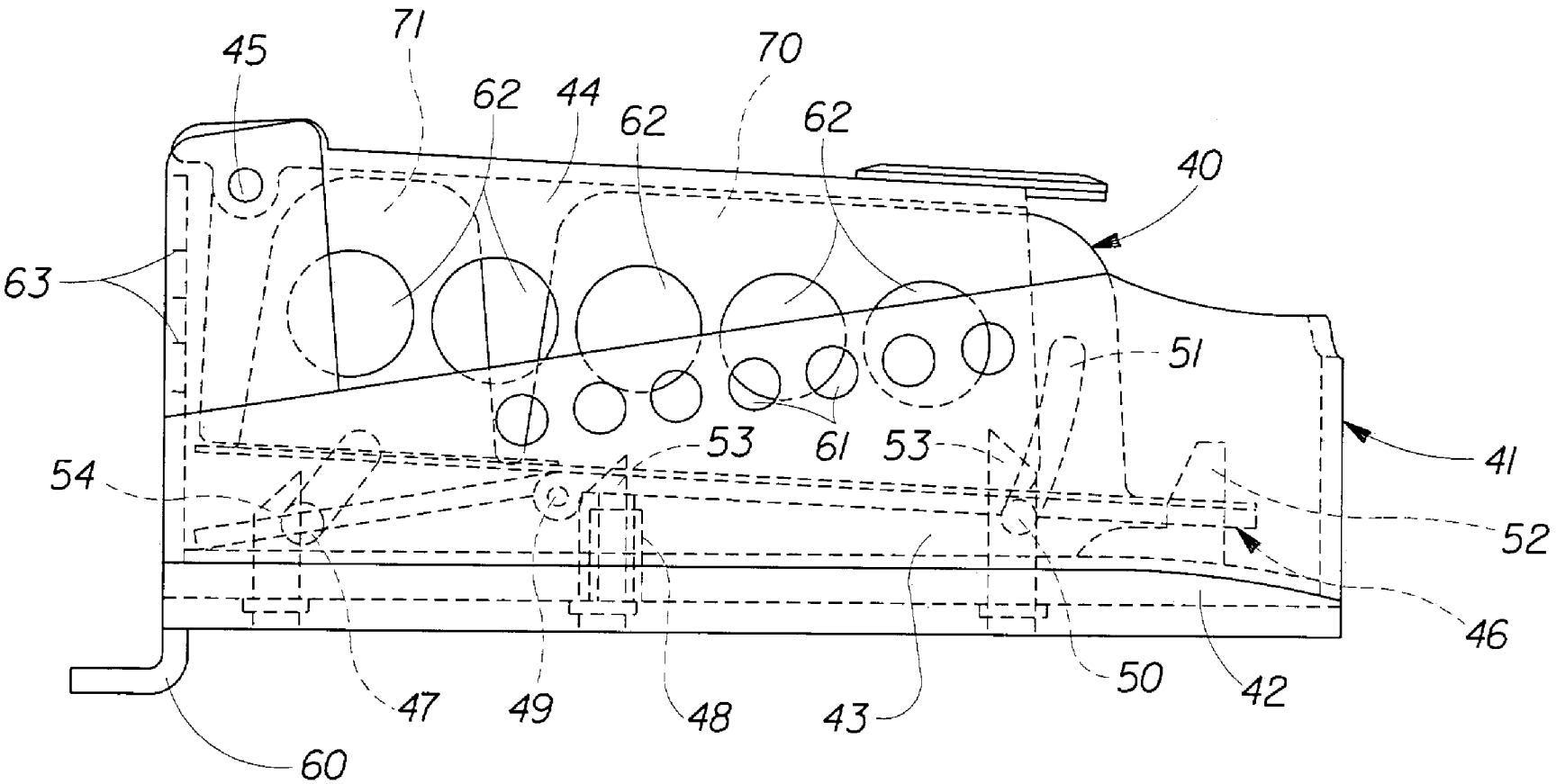

FIGS. 4A, 4B and 4C show transparent side views of an insert 40, such as depicted in FIGS. 1A, 1B and 2A, 2B inserted into a housing structure 41. In all three of the FIGS. 4A–4C views, the housing structure 41 is shown as comprising a base which itself comprises a base plate 42 and a side wall structure 43 affixed to the base plate 42. A lid 44 for the housing structure 41 is attached to the side wall structure 43 at hinge 45.

The base plate 42 comprises attachment means 60 which are used to affix the housing structure 41 to the inside wall of an automatic washing machine drum (not shown). The housing structure 41 is affixed to the washing machine drum in a manner such that the base plate 42 is parallel to the axis of the washing machine drum and is hence perpendicular to the direction of centrifugal force which arises during the washing machine spin cycle.

FIG. 4A shows the housing structure 41 in an open position with the insert 40 partially inserted. FIG. 4B shows the housing structure 41 still in an open position but with the insert 40 completely inserted therein. FIG. 4C shows the housing structure 41, with the insert 40 inside, in a completely closed position, as illustrated hereinbefore in FIG. 3. In all three FIGS. 4A–4C views, the insert 40 is shown as comprising wash additive compartments 70 and rinse additive compartments 71. The insert 40 is inserted into the housing structure with the rinse additive compartments 71 positioned toward the hinge of the housing structure lid.

As shown in the three side views of FIGS. 4A–4C, the housing structure 41 also comprises a hinged positioning plate 46. This hinged positioning plate 46 is affixed or guided in the wall structure 43 by means of attachment means 47. This positioning plate 46 also rests on a compressible pivot point means 48. The positioning plate 46 is hinged at hinge point 49 near the compressible pivot point means 48. The positioning plate 46 also has lugs 50 at the wash additive end opposite the attachment means 47. These lugs 50 fit into guide grooves 51 in each of the opposing walls of the side wall structure 43.

When the lid 44 is closed, this activates rotation of the hinged positioning plate 46 around its hinge point 49 and at the same time depresses the compressible pivot point means 48. The wash additive end of the hinged positioning plate 46 thereby rotates toward the base plate 42 and is kept in the closed position by means of a latch mechanism 52 associated with the base plate 42.

Thus, as the lid 44 is closed, the rotating of the wash additive end of the hinged positioning plate 46, is guided by the lugs 50 in the grooves 51 in the manner of a cam arrangement as the structure is placed in the closed latched position. As a consequence of closing and latching, the wash additive compartment(s) 70 of the insert 40 thus impinge upon sharpened, cylindrical wash additive puncturing means 53 associated with the base plate 42. This action punctures the wash additive compartment(s) 70 of the insert 40 and releases the wash additive contents thereof into the housing structure 41. As shown in FIG. 4C, this action also serves to position the rinse additive compartment(s) 71 of the insert 40 above, but not in contact with, sharpened cylindrical rinse additive puncturing means 54, also associated with the base plate 42.

Later in the laundering operation, during the spin cycle, the centrifugal force generated by the spin cycle causes the rinse additive compartment(s) 71 of the insert 40 to rotate toward the base plate 42. This action then causes the rinse additive compartments 71 of the insert 40 to impinge upon additional rinse additive compartment puncturing means 54 also associated with the base plate 42. The rinse additive compartments 71 of the insert 40 are thus ruptured, thereby releasing their contents into the housing structure 41. The housing side wall structure 43 contains holes 61 through which released contents of the insert compartments can flow into the washing machine drum. Likewise, the lid 44 contains holes 62 for the same purpose.

Rinse additive released by spin cycle centrifugal force is held in the bottom of the housing structure 41 until the spin cycle stops. This released rinse additive can then flow by gravity through holes 63 at the lid hinge end of the housing structure 41 and into the washing machine drum.

In another embodiment shown in FIGS. 5, 5A, 5B, 5C, 5D, and 5E, an insert 140 such as shown in FIGS. 1A, 1B and FIGS. 2A, 2B, is inserted into a housing structure 141. The housing structure 141 comprises a base which includes a base plate 142 and a side wall structure 143 affixed to the base plate 142. A lid 144 for the housing structure 141 is attached to the base plate 142. The lid 144 has a positioning pin 130 and a horizontal divider 131 both of which provide structural support and correct positioning for the insert 140 relative to the puncturing means 153 and 154.

The base plate 142 comprises an attachment means 160 which is used to affix the housing structure 141 to the inside wall of an automatic washing machine drum (not shown). The housing structure is affixed to the washing machine drum in a manner such that the base plate 142 is parallel to the axis of the washing machine drum and is hence perpendicular to the direction of centrifugal force which arises during the washing machine spin cycle.

Figure 5:
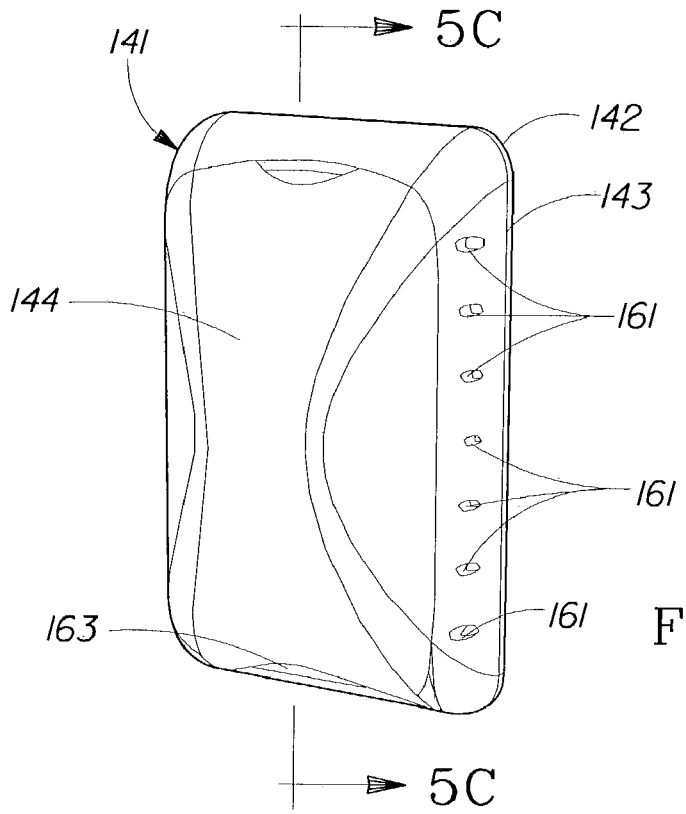
FIG. 5 of the drawings is a perspective view of an embodiment of the housing structure and unit dose insert of the present invention.
Figure 5A:
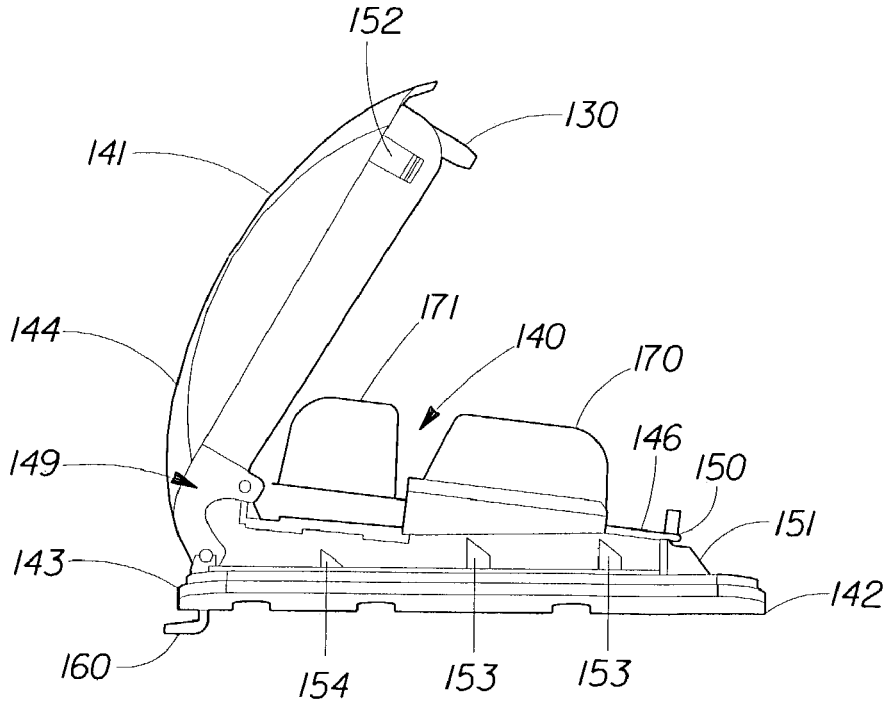
FIG. 5A of the drawings is a side view of the embodiment of FIG. 5.
Figure 5B:
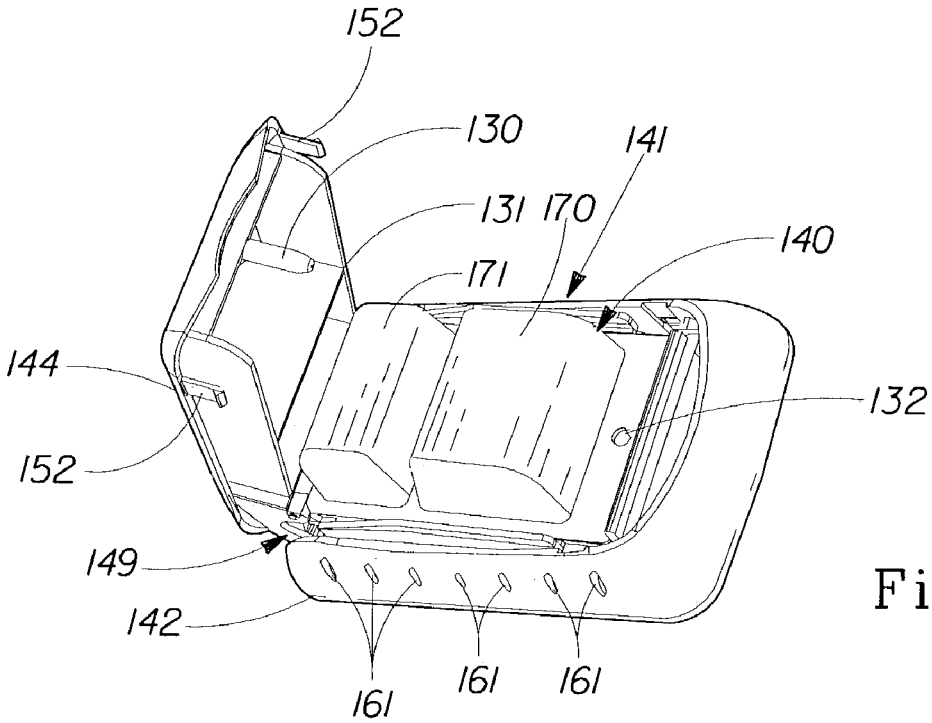
FIG. 5B of the drawings is a top perspective view of the embodiment of FIG. 5.
Figure 5C:
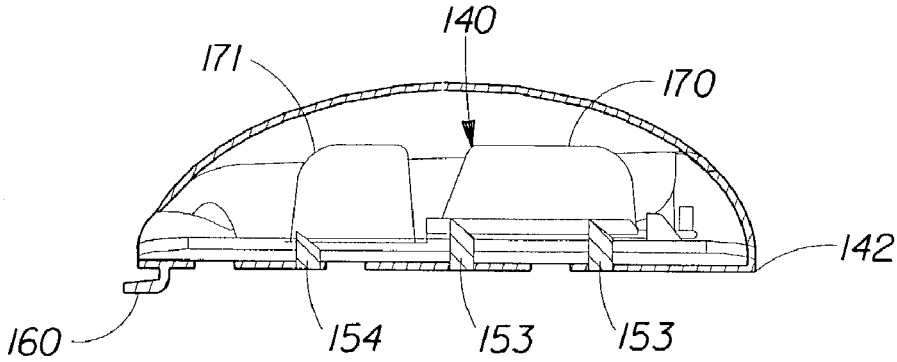
FIG. 5C of the drawings is a cross-sectional view of the embodiment of FIG. 5.
Figure 5D:
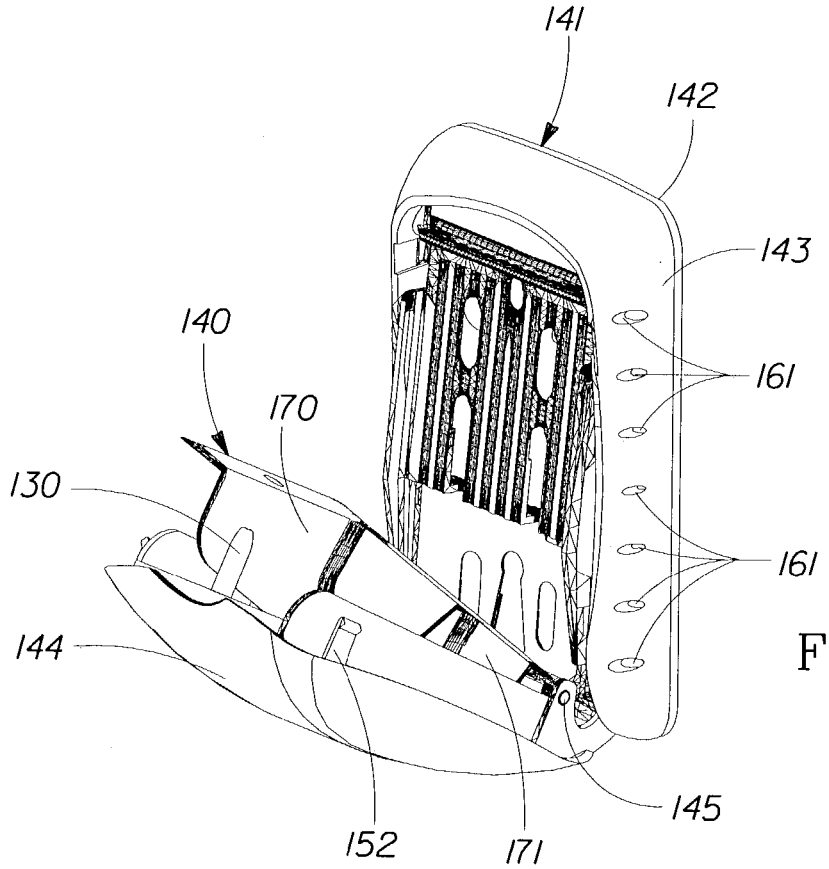
FIG. 5D of the drawings is a perspective view of the embodiment of FIG. 5.
Figure 5E:
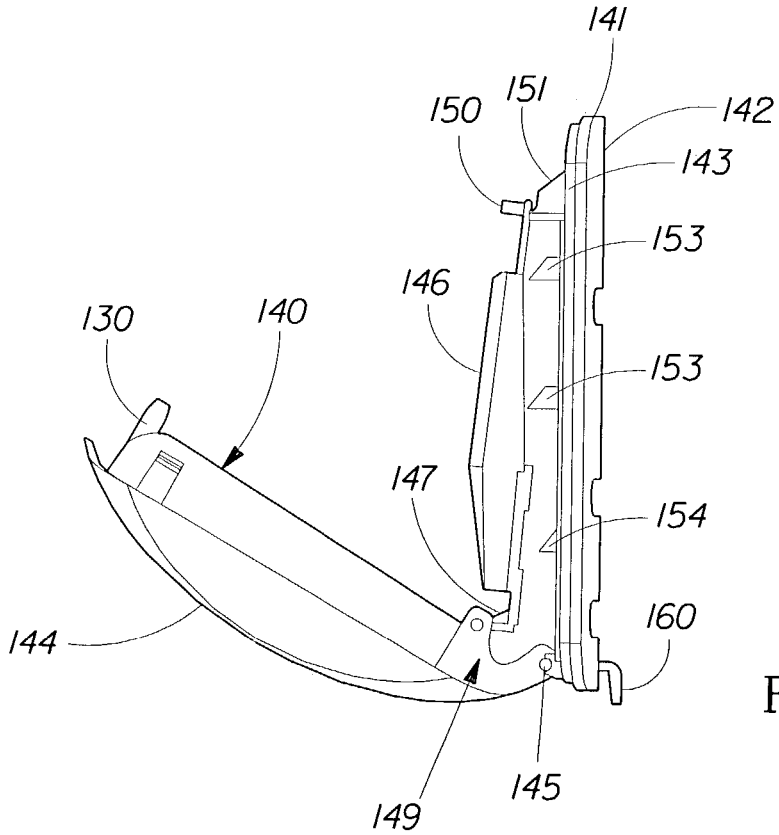
FIG. 5E of the drawings is a side perspective view of the embodiment of FIG. 5.

FIG. 5D shows the housing structure 141 in an open position with the insert 140 partially inserted. FIG. 5E shows the housing structure 141 in a vertical side view, in an open position but with the insert 140 completely inserted into the lid 144. FIG. 5C shows the housing structure 141 in a completely closed position with the insert 140 inside. Referring to FIGS. 5A, 5B, 5C, and 5D, the insert 140 is shown as comprising wash additive compartment(s) 170 and rinse additive compartment(s) 171. The insert 140 is inserted into the housing structure 141 with the rinse additive compartment(s) 171 positioned toward the hinge 145 of the housing structure lid 144.

As shown in FIGS. 5A and 5E, the housing structure 141 also comprises a hinged positioning plate 146. This hinged positioning plate 146 is affixed to the housing lid 144 by attachment means 147. The positioning plate 146 is hinged at hinge point 149 near the bottom of lid 144. The positioning plate 146 also has lugs 150 which fit into cam-like inclined guide grooves 151 in each of the opposing walls of the side wall structure 143.

When placing insert 140 into the lid 144, the insert 140 is slid into positioning pin 130 through keyhole 132 so that when the lid 140 is closed and the insert is in a vertical position, the insert is suspended freely from pin 130. When the lid 144 is closed, the positioning plate 146 moves around its hinge point 149 and is guided toward the base plate 142 by the lugs 150 in the cam track grooves 151. The end of the hinged positioning plate 146 nearest to the wash additive compartment(s) 170 thereby rotates toward the base plate 142 and is kept in the closed position by means of a latch mechanism 152 associated with the side walls 143.

Thus as the lid 144 is closed, the rotating of the wash additive end of the hinged positioning plate 146, is guided by the lugs 150 in the grooves 151 in the manner of a cam arrangement as the structure is placed in the closed latched position. As a consequence of closing and latching, the wash additive compartment(s) 170 of the insert 140 impinge upon cylindrical wash additive puncturing means 153 associated with the base plate 142. This action punctures the wash additive compartment(s) 170 of the insert 140 and releases the wash additive contents into the housing structure 141. As shown in FIG. 5, the released wash additive can then flow by gravity through an opening 163 in the housing structure 141 and into the washing machine. As shown in FIG. 5C, this action also serves to position the rinse additive compartment(s) 171 of the insert 140 above, but not in contact with the rinse additive puncturing means 154.

Later in the laundering operation, during the spin cycle, the centrifugal force generated by the spin cycle causes the rinse additive compartment(s) 171 of the insert 140 to rotate toward the base plate 142. The rinse additive compartments 171 of the insert 140 are thus ruptured, thereby releasing their contents into the housing structure 141. The housing side wall structure 143 contains holes 161 through which water in the washing machine can flow into the housing structure 141 in order to help drain the additive from the housing structure 141.

Rinse additive released by spin cycle centrifugal force is held in the housing structure 141 until the spin cycle stops. This released rinse additive can then flow by gravity through holes 163 at the lid hinge end of the housing structure 141 and into the washing machine drum.

The method of using the above-described system for sequentially dispensing laundry additive materials into a fabric laundering operation can be illustrated by the following example:

EXAMPLE

A three-compartment unit dose insert is prepared having the general configuration of that shown in FIGS. 2A–2B. The insert is fashioned from 0.381 mm thick polypropylene and is made by a thermoforming process. The insert so formed is 11.0 cm long, 7.0 cm wide and 2.5 cm thick and includes the three compartments, 21, 22 and 23 shown in FIGS. 2A–2B.

Approximately 55 grams of a compact aqueous heavy duty liquid (HDL) detergent product are placed in the larger wash additive compartment 21 of the FIGS. 2A, 2B insert. Such an HDL comprises approximately 40% by weight of anionic and nonionic surfactants, 8% by weight of organic builders, 19% by weight of organic solvents and minor amounts of other ingredients such as borax and enzymes.

Approximately 11 grams of a liquid bleaching composition are placed in the smaller wash additive compartment 22 of the FIGS. 2A, 2B insert. Such a composition comprises a 6% by weight aqueous solution of sodium hypochlorite along with minor amounts of perfume.

Approximately 30 grams of a liquid fabric softener composition are placed in the rinse additive compartment 23 of the FIG. 2 insert. Such a fabric softener composition comprises approximately 4.5 by weight of ditallowdimethyl ammonium chloride (DTDMAC) softener active plus minor amounts of perfume and silicone.

The insert, with the compositions as hereinbefore described in each of the three compartments, is sealed with a 0.0304 mm layer of oriented polypropylene film placed over the open compartments. The sealed unit dose insert package is then placed in a rigid lidded housing structure of the type shown in FIGS. 3 and 4A–4C. Prior to insertion of the unit dose package, this rigid housing structure is attached to the circumferential wall of the upright drum of a top-loading Kenmore 70 Series automatic washing machine. The housing is attached approximately 20 cm from the floor of the drum with the lid hinge closest to the floor of the drum and with the structure backplate parallel to the circumferential wall of the drum. The open end of the housing structure thus faces the top of the washing machine.

With the lidded housing structure in the open configuration, the three-compartment unit dose insert is placed therein as shown in FIGS. 4A and 4B. Fabrics to be laundered are then placed in the washing machine. Just prior to starting the washing machine on its laundering cycle, the lid of the housing structure is closed providing the structure and insert configuration as shown in FIG. 4C. The washing machine is then started on its cycle.

Closing of the housing structure lid with the insert inside causes the wash additive puncturing means 53 (FIG. 4C) to rupture the layer of sealing material covering the each of the additive compartments 21 and 22 (FIGS. 2A, 2B) of the insert. Such rupturing releases the wash additive ingredients together into the wash water which fills the tub at the beginning of the laundry cycle. The wash additive ingredients are washed from the housing structure through the holes 61, 62 and 63 (FIGS. 4A–4C) in the walls of the housing structure, thereby providing wash water to which about 66 grams of wash additive ingredients (HDL plus bleach) have been added.

After a wash cycle of approximately 14 minutes, the washing machine begins its spin cycle to remove the wash water from the drum. The centrifugal force generated by this spin cycle serves to push the sealed rinse additive compartment 71 (FIG. 4) of the insert within the housing against the rinse additive rupturing means 54 (FIG. 4) which forms part of the rigid housing. This action causes the seal of the rinse additive compartment 71 (FIG. 4) to rupture and release the fabric softener contents of the rinse additive compartment into the housing structure. The continuing centrifugal force of the spin cycle holds the released fabric softener composition in an area of the housing structure where there are no holes so that the released fabric softener rinse additive stays within the housing structure during the spin cycle.

After 2 minutes of the spin cycle, the spinning of the washing machine drum ceases and the drum begins filling with rinse water. At the same time, the rinse additive fabric softener composition which has been held within the housing structure during the spin cycle flows from the housing structure primarily through the holes 63 (FIG. 4) and into the rinse water. Rinse water in and entering the drum can also now enter the housing structure and wash out any residual fabric softener composition from the open rinse additive compartment. In this manner approximately 30 grams of the fabric softener rinse additive composition are introduced into the rinse water in the washing machine drum.

The rinse cycle continues for 5 minutes and thereafter the fabrics in the drum are wrung dry by a final spin cycle. Wash and rinse additives from the insert have thus been delivered sequentially to the wash and rinse cycles respectively during the laundering operation.

The rigid housing structure and the multi-compartmented inserts therefor may be conveniently commercialized by marketing them in the form of kits. Thus the housing and insert which are to be used together in the systems and methods of this invention may be sold together, packaged as a unitary commercial kit product. Furthermore, the multi-compartmented unit dose inserts may be sold by themselves as refills for use in a rigid housing structure which the consumer may have previously purchased and has already installed on the washing machine to be used for practice of this invention. In the case of refills, the inserts can be marketed in combination with a set of instructions which describes the previously-purchased housing structure into which the unit does fits and further describes the method of setting up and operating the housing/insert system in the consumer's automatic washing machine.

All documents cited are, in relevant part, incorporated herein by reference. The citation of any document is not to be construed as an admission that it is prior art with respect to the present invention. While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A system for providing sequential dispensing of laundry additive materials into several stages of a laundering cycle which occur during an operation of an drum-containing automatic fabric laundering washing machine, which system comprises:

A) a rigid housing structure positioned within said washing machine in a fixed spatial relationship to said washing machine drum, which housing structure comprises a base and an openable and closable lid for said base;

B) a multi-compartmented insert which can be placed within said housing structure at the beginning of the laundering operation, said insert containing within at least two different compartments thereof at least two different laundry additive materials which are to be added at different times to the contents of the washing machine drum during the laundering cycle;

C) means associated with said rigid housing structure for opening at least a first compartment of the multi-compartmented insert upon closing of the lid of said housing structure when said insert is positioned inside said housing with said opening permitting the dispensing of the material within said opened compartment into said washing machine drum; and D) means associated with said housing structure and/or with said multi-compartmented insert for opening one or more additional compartments of said insert containing laundry additive material different from that in said previously opened first compartment, said opening of said additional compartments occurring after initiation of the spin cycle of said washing machine operation, and said means for opening said additional compartments being activated by the centrifugal force arising from the spin cycle during the operation of said automatic washing machine; said opening permitting the dispensing of the material within said additional compartment(s) into said washing machine drum.

2. A system according to claim 1 wherein said rigid housing structure is positioned within said washing machine drum in a location where it will be contacted with the wash or rinse water in or being added to said drum.

3. A system according to claim 2 wherein said insert contains one compartment for wash additive material and one compartment for rinse additive material.

4. A system according to claim 2 wherein said insert contains two compartments for wash additive material and one compartment for rinse additive material.

5. A system according to claim 2 wherein said compartment opening means associated with said housing structure comprises means for puncturing at least one of the compartments of said insert.

6. A kit comprising a combination of a rigid housing structure and one or more multi-compartmented inserts, both as described in claim 7.

7. A system according to claim 2 wherein said housing structure comprises means for opening at least one wash additive compartment of said insert and at least one rinse additive compartment of said insert.

8. A system according to claim 2 wherein at least one of said insert compartment opening means is associated with the base of said housing structure.

9. A system according to claim 2 wherein at least one of said insert compartment opening means is associated with the lid of said housing structure.

10. A system according to claim 2 which delivers from about 15 to 100 grams of wash additive material to at least one wash cycle and from about 5 to 50 grams of rinse additive material to at least one rinse cycle during said fabric laundering operation.

11. A system according to claim 2 wherein said housing structure is configured to retain substantially all of the contents of said opened rinse additive compartment(s) of the insert within said housing structure during the spin cycle of the laundering operation.

12. A system according to claim 12 wherein, after cessation of the spin cycle, substantially all of the contents of the opened rinse additive compartment(s) of the insert flow into said washing machine drum through holes in said housing structure.

13. A system according to claim 1 wherein said multi-compartmented insert is rigid and constructed from thermoformed polymeric material.

14. A system according to claim 1 wherein said multi-compartmented insert is constructed at least in part from flexible polymeric material.

15. A kit comprising a multi-compartmented insert in combination with a set of instructions describing the method of using said insert in the system of claim 1.

16. A method for providing sequential dispensing of laundry additive materials into several stages of a laundering cycle which occur during an operation of an drum-containing automatic fabric laundering washing machine, which method comprises:

A) positioning a rigid housing structure within said washing machine in a fixed spatial relationship to said washing machine drum, which housing structure comprises a base and an openable and closable lid for said base;

B) placing within said housing structure with its lid open at the beginning of the laundering operation, a multi-compartmented insert containing within at least two different compartments thereof at least two different laundry additive materials which are to be added at different times to the contents of the washing machine drum during the laundering cycle;

C) closing the lid of said housing structure with said insert inside to thereby activate means associated with said rigid housing structure to open at least a first compartment of the multi-compartmented insert and to thereby permit dispensing of the material within said opened compartment into said washing machine drum; and D) running said automatic washing machine through its operational cycle, including through its spin cycle to thereby activate means associated with said housing structure and/or with said multi-compartmented insert to open one or more additional compartments of said insert containing laundry additive material different from that in said previously opened first compartment, said opening of said additional compartments occurring after initiation of the spin cycle of said washing machine operation, and said means for opening said additional compartments being activated by the centrifugal force arising from the spin cycle; said opening further permitting the dispensing of the material within said opened compartment(s) into said washing machine drum.

17. A method according to claim 16 wherein said rigid housing structure is positioned within said washing machine drum in a location where it will be contacted with the wash or rinse water in or being added to said drum.

18. A method according to claim 17 wherein said insert contains one compartment for wash additive material and one compartment for rinse additive material.

19. A method according to claim 17 wherein said insert contains two compartments for wash additive material and one compartment for rinse additive material.

20. A method according to claim 17 wherein said compartment opening means associated with said housing structure comprises means for puncturing at least one of the compartments of said insert.

21. A method according to claim 17 wherein said housing structure comprises means for opening at least one wash additive compartment of said insert and at least one rinse additive compartment of said insert.

22. A method according to claim 17 wherein at least one of said insert compartment opening means is associated with the base of said housing structure.

23. A method according to claim 17 wherein at least one of said insert compartment opening means is associated with the lid of said housing structure.

24. A method according to claim 17 which delivers from about 40 to 100 grams of wash additive material to at least one wash cycle and from about 10 to 50 grams of rinse additive material to at least one rinse cycle during said fabric laundering operation.

25. A method according to claim 17 wherein said housing structure is configured to retain substantially all of the contents of said opened rinse additive compartment(s) of the insert within said housing structure during the spin cycle of the laundering operation.

26. A method according to claim 25 wherein, after cessation of the spin cycle, substantially all of the contents of the opened rinse additive compartment(s) of the insert flow into said washing machine drum through holes in said housing structure.

27. A method according to claim 16 wherein said multi-compartmented insert is rigid and constructed from thermoformed polymeric material.

28. A method according to claim 16 wherein said multi-compartmented insert is constructed at least in part from flexible polymeric material.

* * * * *